United States Patent [19]

Edwards

[11] 4,060,920

[45] Dec. 6, 1977

[54] SIGNBOARD

[76] Inventor: Lindell N. Edwards, 10601 Leebur Drive, St. Louis, Mo. 63128

[21] Appl. No.: 679,214

[22] Filed: Apr. 22, 1976

[51] Int. Cl.[2] ..... G09F 7/02

[52] U.S. Cl. ..... 40/140; 40/68

[58] Field of Search ..... 40/140, 68 R, 64, 125 R, 40/125 H, 124

[56] References Cited

U.S. PATENT DOCUMENTS

| | | | |
|---|---|---|---|
| 1,144,173 | 6/1915 | Corcoran | 40/68 |
| 1,369,170 | 2/1921 | Gilbert | 40/68 |
| 2,388,297 | 11/1935 | Slaughter | 46/30 X |
| 2,510,224 | 6/1950 | Hettinger | 40/140 X |
| 3,229,398 | 1/1966 | Kopatich | 40/140 |
| 3,289,340 | 12/1966 | Edwards | 40/140 |
| 3,780,469 | 12/1973 | Hankowski | 272/56 SR |
| 3,891,092 | 6/1975 | Surrette | 211/13 |
| 3,928,340 | 1/1976 | Attwood | 40/140 X |

FOREIGN PATENT DOCUMENTS

| | | | |
|---|---|---|---|
| 1,093,345 | 5/1955 | France | 40/125 R |

*Primary Examiner*—Louis G. Mancene
*Assistant Examiner*—Wenceslao J. Contreras
*Attorney, Agent, or Firm*—Rogers, Eilers & Howell

[57] ABSTRACT

A signboard which is tubular in configuration has elongated grooves in the surface thereof that can accommodate the resilient clips of indicia. That signboard occupies only a limited amount of floor space when it is mounted with its axis vertical; and the elongated grooves in the surface of that signboard facilitate the positioning of indicia at levels at which that indicia is readily visible.

10 Claims, 14 Drawing Figures

FIG. 6.
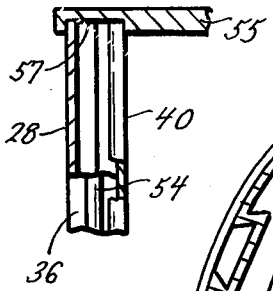
FIG. 2.
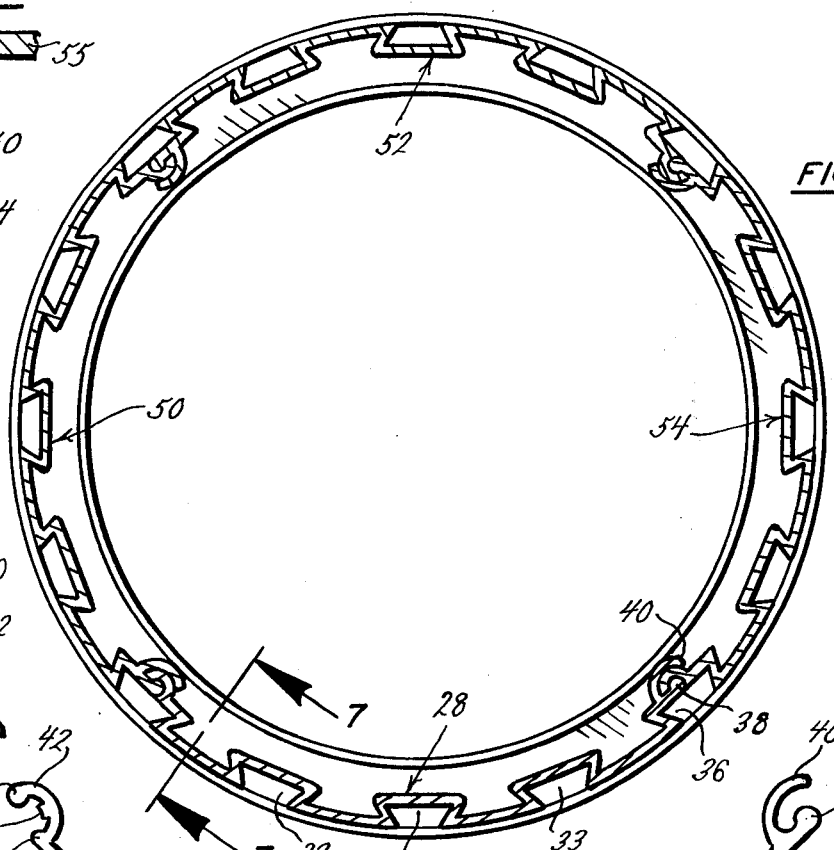
FIG. 7.
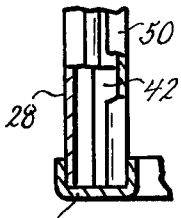
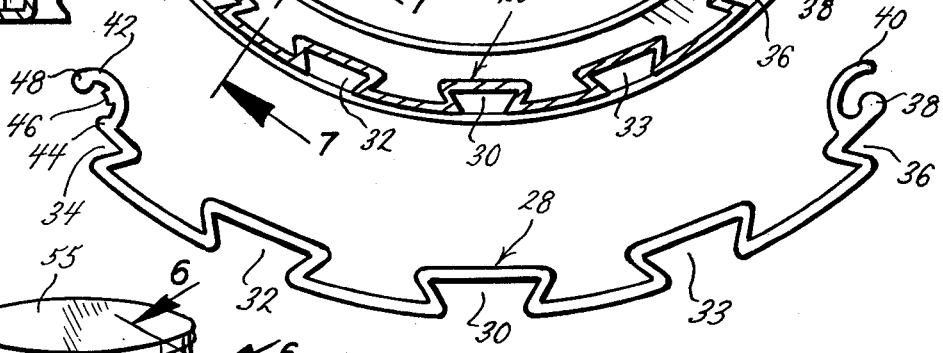
FIG. 4.
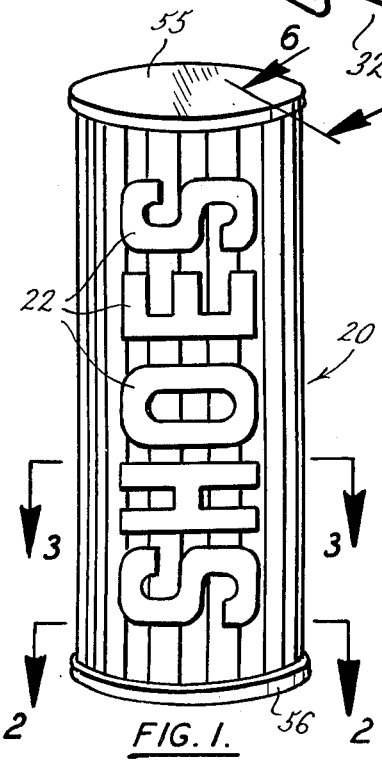
FIG. 1.
FIG. 3.
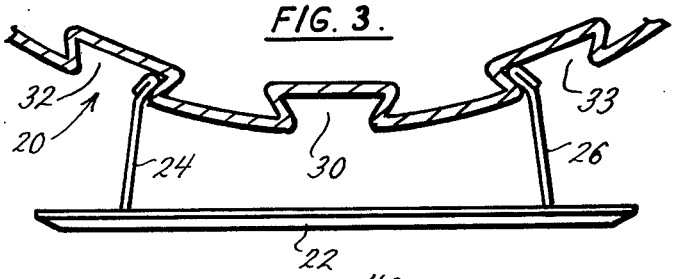
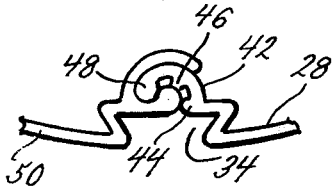
FIG. 5.

FIG. 8.
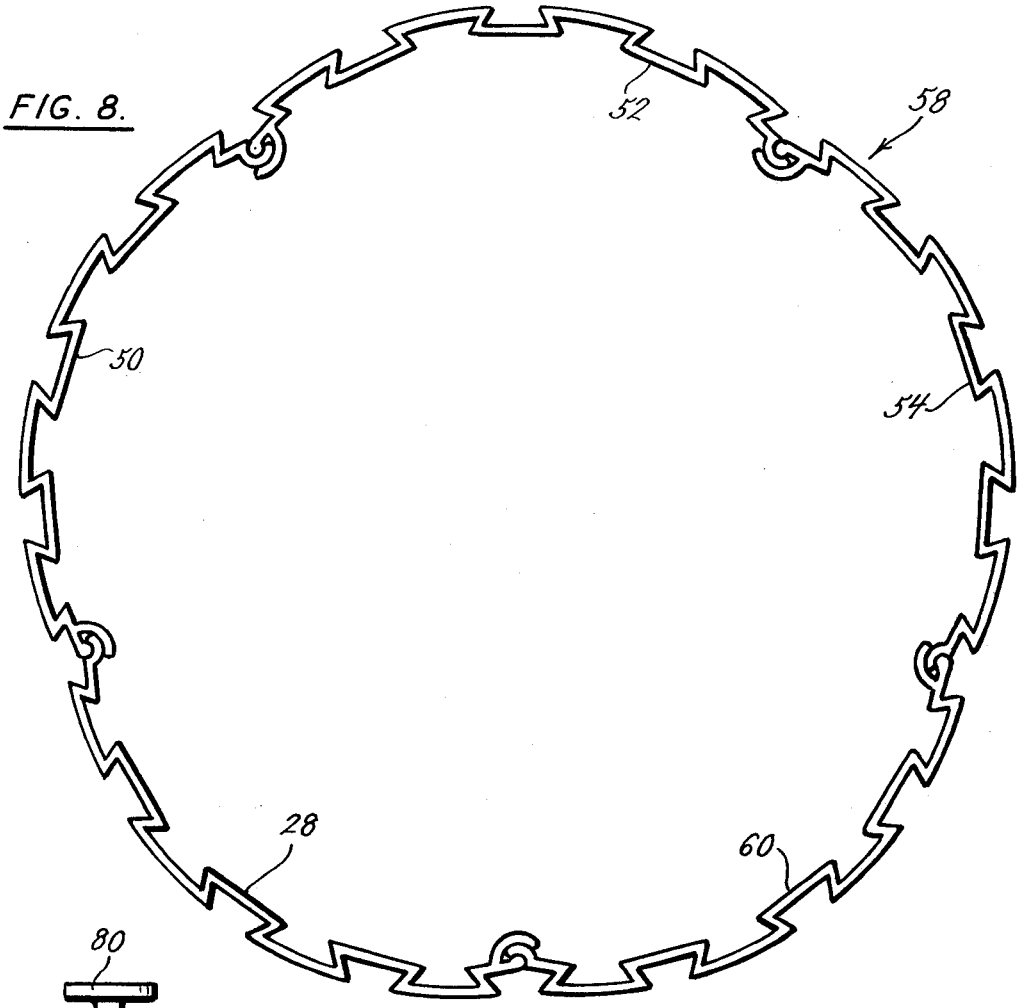
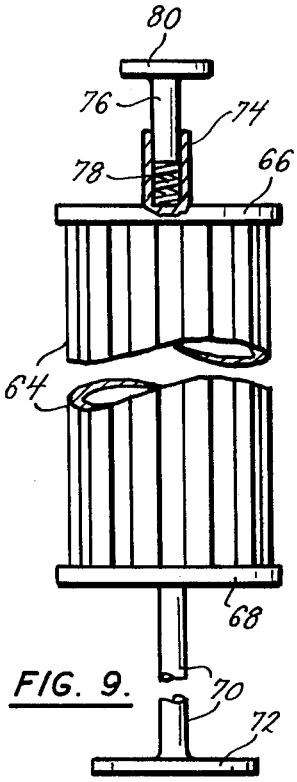
FIG. 9.
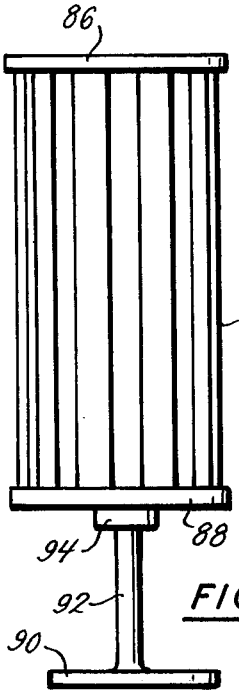
FIG. 10.
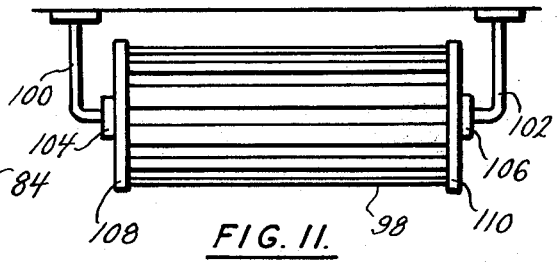
FIG. 11.

SIGNBOARD

BACKGROUND OF THE INVENTION

Signboards usually are made planar in nature, and they frequently are stiffened and reinforced by frames. Such signboards frequently occupy or obstruct appreciable amounts of floor space; and they usually require the indicia therefor to be located within a display area of limited vertical dimensions. In addition, the use of stiffening and reinforcing frames increases the weight, cost and size of such signboards.

SUMMARY OF THE INVENTION

The present invention provides a signboard which is tubular in configuration and which is made from a number of interlocking sections. Those interlocking sections stiffen and rigidify that signboard to such an extent that a reinforcing and supporting frame is not required. That signboard can be mounted so the axis thereof is vertical; and, where that is done, that signboard will occupy only a small amount of floor space. It is, therefore, an object of the present invention to provide a signboard which is tubular in configuration and which is made from a number of elongated sections that can be interlocked together.

The elongated sections of the signboard provided by the present invention have elongated grooves therein; and those elongated grooves accommodate the resilient clips of indicia. Those elongated grooves permit those clips, and hence those indicia, to be positioned at desired points along the length of that signboard. As a result, when the axis of that signboard is vertical, those indicia can be set at levels which are most likely to provide optimum viewing of those indicia. It is, therefore, an object of the present invention to provide a signboard which can have the axis thereof set vertical and which includes a number of elongated sections that have elongated grooves therein which permit the clips on indicia to be set at desired positions along those elongated grooves.

The tubular configuration of the signboard provided by the present invention enables that signboard to be telescoped over a post or other upright. As a result, it frequently is a simple matter to install that signboard. Further, because that signboard can conceal that post or other upright, that post or upright need not be ornamental in configuration. It is, therefore, an object of the present invention to provide a signboard which can be telescoped over, and which can conceal, a post or upright.

Other and further objects and advantages of the present invention should become apparent from an examination of the drawing and accompanying description.

In the drawing and accompanying description, some preferred embodiments of the present invention are shown and described but it is to be understood that the drawing and accompanying description are for the purpose of illustration only and do not limit the invention and that the invention will be defined by the appended claims.

BRIEF DESCRIPTION OF PREFERRED EMBODIMENTS

In the drawing,

FIG. 1 is a perspecitve view of one preferred embodiment of signboard that is made in accordance with the principles and teachings of the present invention, FIG. 2 is a sectional view, on a larger scale, through the signboard of FIG. 1, and it is taken along the plane indicated by the line 2—2 in FIG. 1, FIG. 3 is a further sectional view, on a still larger scale, through the signboard of FIG. 1, and it is taken along the plane indicated by the line 3—3 in FIG. 1, FIG. 4 is an end elevational view, on the scale of FIG. 3, of one of the elongated sections which are interconnected to make the signboard of FIG. 1, FIG. 5 is an end elevational view, approximately on the scale of FIG. 3, of the interacting surfaces on adjacent elongated sections of the signboard of FIG. 1, FIG. 6 is a sectional view, on the scale of FIG. 3, through the signboard of FIG. 1, and it is taken along the plane indicated by the line 6—6 in FIG. 1, FIG. 7 is another sectional view, on the scale of FIG. 3, through the signboard of FIG. 1, and it is taken along the plane indicated by the line 7—7 in FIG. 2, FIG. 8 is an end view of a signboard which is larger in diameter than the signboard of FIG. 1, FIG. 9 is a broken, partially-sectioned, front elevational view of another preferred embodiment of signboard and of supports for that signboard, FIG. 10 is a front elevational view of a further preferred signboard and of a support therefor, FIG. 11 is a front elevational view of a horizontally-directed signboard, FIG. 12 is a broken front elevational view of two of the signboards of the present invention encircling the supports of a display, FIG. 13 is an end elevational view, on the scale of FIG. 3, of an elongated section for a signboard, and it has a smaller angular extent than does the elongated section of FIG. 4, and FIG. 14 is an end elevational view, on the scale of FIG. 3, of an elongated section for a signboard, and it has an angular extent which is larger than that of the elongated section of FIG. 13 but which is smaller than that of the elongated section of FIG. 4.

DETAILED DESCRIPTION OF PREFERRED EMBODIMENTS

Figure 12:
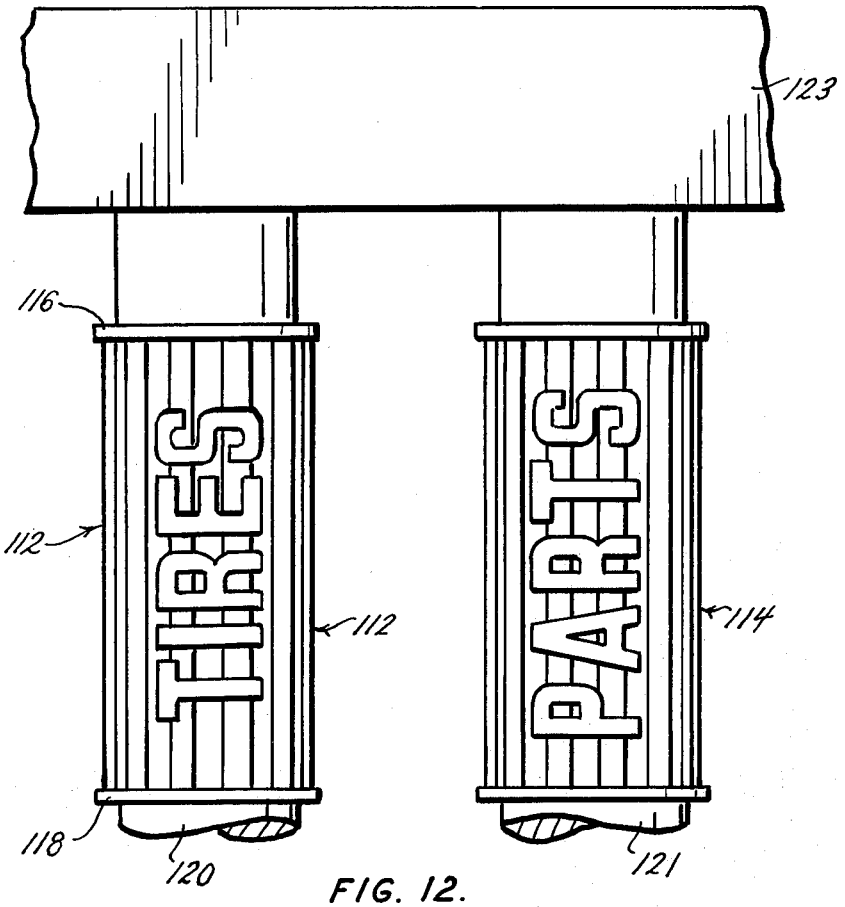

Referring particularly to FIGS. 1–7, the numeral 20 generally denotes a signboard which is tubular in cross section and which has a number of indicia 22 spaced axially along a portion of the outer surface thereof. Each of those indicia has two resilient clips 24 and 26, as shown particularly by FIG. 3; and those clips preferably will be attached to the indicia 22 in the same manner in which the clips of my U.S. Pat. No. 3,225,477 are attached to indicia. The clips 24 and 26 have the free ends thereof bent to define obtuse angles; and those free ends incline toward each other.

The signboard 20 is constituted by four elongated sections 28, 50, 52, and 54. All of those sections are identical; and hence only the section 28 need be described in detail. As indicated particularly by FIGS. 2–5, each of the sections 28, 50, 52 and 54 is arcuate in cross section; and each of those sections has an angular extent of 90°. Consequently, when they are assembled together, those sections are intended to, and do, make the signboard 20 tubular with a circular cross section.

The numeral 30 denotes an elongated, axially-extending groove which is formed in the convex exterior of the section 28; and that groove extends throughout the full length of that section. As shown particularly by FIGS. 2–4, that groove is generally frusto-triangular in cross section; and the closed end of that groove is wider than the open end of that groove. The numeral 32 denotes a similar elongated, axially-extending groove in the convex exterior of the section 28; and that groove is parallel to, but is spaced circumferentially from, the groove 30. In the preferred embodiment of signboard shown by FIG. 1, the center-to-center angular spacing between the grooves 30 and 32 is 22½°. The numeral 33 denotes another elongated, axially-extending groove which is similar to the groove 30; and that groove is in the convex exterior of the section 28 and is parallel to, but is spaced circumferentially from, the groove 30. The center-to-center angular spacing between the grooves 30 and 33 also is 22½°. The numeral 34 denotes an elongated, axially-extending partial groove which is provided adjacent one axially-extending edge of the section 28; and the numeral 36 denotes an elongated, axially-extending partial groove which is provided adjacent the opposite axially-extending edge of that section. The elongated partial groove 34 is intended to, and can, coact with that elongated partial groove of the section 50, which corresponds to the partial groove 36, to consistute a groove that has the same dimensions as any of the elongated grooves 30, 32 and 33—as shown by FIG. 2. The center spacing between the elongated groove 32 and the elongated groove of which the partial groove 34 is a part is 22½°. The elongated partial groove 36 is intended to, and can, coact with that elongated partial groove of the section 54, which corresponds to the partial groove 34, to constitute a groove which has the same dimensions as any of the elongated grooves 30, 32, and 33—as shown by FIG. 2. The center-to-center angular spacing between the elongated groove 33 and the elongated groove of which the partial groove 36 is a part is 22½°.

The numeral 38 denotes an elongated, axially-extending projection at the free edge of the inner wall of the partial groove 36; and that projection is circular in cross section—as shown particularly by FIG. 4. The numeral 40 denotes an elongated, axially-extending wall of circular cross-section and of about 135° angular extent which extends both inwardly and laterally from the inner face of the inner wall of the partial groove 36 of the section 28—as shown by FIG. 4. That wall is concentric with, and is spaced radially from, the projection 38 on the section 28, as shown by FIG. 4.

The numeral 42 denotes an elongated, axially-extending wall of circular cross-section and of about 135° angular extent which extends both inwardly and laterally from the free edge of the inner wall of the partial groove 34 of the section 28, as shown particularly by FIG. 4. The wall 42 has an outer radius which is just slightly smaller than the inner radius of the wall 40; and the inner radius of the wall 42 is slightly larger than the radius of the projection 38. The numeral 44 denotes an elongated, axially-extending abutment which projects from that portion of the concave surface of the wall 42 which is adjacent the free edge of the inner wall of the partial groove 34, as shown in FIG. 4. The numeral 46 denotes an elongated, axially-extending abutment which is adjacent the circumferential midpoint of the concave surface of the wall 42; and the numeral 48 denotes an elongated, axially-extending abutment which is adjacent the free edge of the wall 42 and which projects from the concave surface of that wall. The abutments 44, 46 and 48 coact to define an axially-extending, generally-cylindrical space which can accommodate that projection on the section 50 which is identical to the projection 38. As shown particularly by FIG. 5, the abutments 44, 46 and 48 confront and are immediately adjacent that projection on the section 50.

The projection 38, the walls 40 and 42, and the abutments 44, 46 and 48 constitute interacting surfaces on the section 28 which coact with complementary interacting surfaces on the sections 50 and 54 to interlock those three sections together in assembled relation. Similar interacting surfaces on the section 52 can coact with complementary interacting surfaces on the sections 50 and 54 to interlock those three sections together in assembled relation. The interacting surfaces of any three of the sections 28, 50, 52 and 54 can be interfitted in hinge-like fashion; but the interacting surfaces of the fourth of those sections must be interfitted with the complementary interacting surfaces of the adjacent two sections by a telescoping action. Once the interacting surfaces of all four of the sections 28, 50, 52 and 54 have been interfitted, those interacting surfaces will solidly interlock those sections against accidental separation. Furthermore, those interacting surfaces will coact to prevent or minimize looseness or play between those sections. The overall result is that when the sections 28, 50, 52 and 54 have been assembled together to constitute the signboard 20, that signboard will be sturdy and rugged and will not require a stiffening and reinforcing frame.

As indicated particularly by FIG. 2, each of the sections 28, 50, 52 and 54 has three full, elongated, axially-extending grooves therein plus two partial, elongated, axially-extending grooves therein. When those four sections are assembled together to constitute the signboard 20, the eight partial grooves interact to constitute four grooves; and hence the signboard 20 has a total of 16 full, elongated, axially-extending grooves therein. Where the indicia 22 and the signboard 20 have the relative sizes indicated by FIGS. 1 and 3, the free ends of the clips 24 and 26 will lodge within grooves, such as the grooves 32 and 33, which are spaced apart by an intervening groove, such as the groove 30. The free ends of the clips 24 and 26 will abut and bear against those edges, of the two spaced-apart grooves, which are closest to each other.

Figure 13:
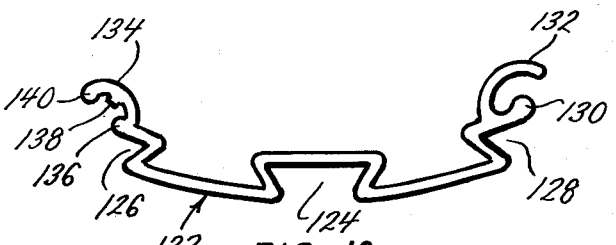

If desired, each of the sections 28, 50, 52 and 54 could be made with more or fewer full, elongated, axially-extending grooves. For example, as shown by FIG. 13, an elongated section 122 for a signboard has one full elongated groove 124 plus two partial elongated grooves 126 and 128 therein. That elongated section is arcuate in cross section, as shown by FIG. 13; and it is shown with a radius which is the same as the radius of the elongated section 28 in FIG. 4. However, instead of having an angular extent of ninety degrees, as does the section 28, the section 122 has an angular extent of only 45°.

The groove 124 is identical to the groove 30 in FIG. 2; and the partial grooves 126 and 128 are, respectfully, identical to the partial grooves 34 and 36. The center-to-center angular spacing, between the elongated groove 124 and each of the elongated grooves which will be constituted by the partial grooves 126 and 128 and by complementary partial grooves, is 22½°.

The section 122 has an elongated, axially-extending cylindrical projection 130 and an elongated, axially-extending wall of circular-cross section which are identical, respectively, to the projection and wall 38 and 40 of the section 28. Similarly, the section 122 has an elongated, axially-extending wall 134 of circular-cross section which is identical to the wall 42 of the section 28;

and it also has elongated, axially-extending abutments 136, 138 and 140 which are identical, respectively, to the abutments 44, 46 and 48 on the section 28.

Eight of the sections 122 could be assembled together to provide a signboard which had the exact same size and dimensions as the signboard 20 of FIGS. 1–7. If desired, however, somewhat fewer than, or somewhat more than, eight of the sections 122 could be assembled together to make a signboard which had a slightly larger cross section or a slightly smaller cross section than that of the signboard 20. Further, if desired, various combinations of sections 28 and 122 could be interlocked to provide a signboard having a desired number of elongated sections.

Figure 14:
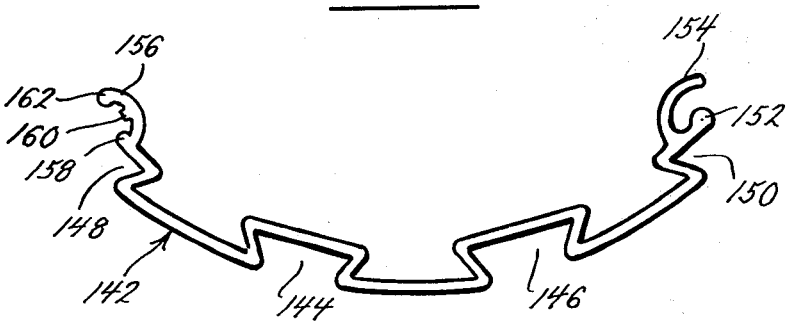

The numeral 142 in FIG. 14 generally denotes an elongated section which has two full elongated grooves 144 and 146 therein plus two elongated partial grooves 148 and 150 therein. The section 142 is shown as having a radius which is smaller than that of either of the sections 28 and 122. As a result, although the grooves 144 and 146 are very similar to the groove 30 of section 28, and although the partial grooves 148 and 150 are very similar to the partial grooves 34 and 36 of section 28, the section 142 has an angular extent of ninety degrees even though it has just two full elongated grooves.

The section 142 has an elongated axially-extending projection 152 of cylindrical form and an adjacent arcuate wall 154 which are substantially-identical to the projection 38 and the wall 40 of the section 28. Also, the section 142 has an elongated axially-extending arcuate wall 156 which is substantially identical to the arcuate wall 42 of the section 28; and it also has elongated axially-extending abutments 158, 160 and 162 which are substantially identical respectively, to the abutments 44, 46 and 48 of the section 28.

Four of the sections 142 could be interlocked together to provide a signboard which would resemble the signboard 20 of FIGS. 1–7 but which would have only twelve elongated axially-extending grooves therein. Moreover, that signboard would have a diameter which was smaller than the diameter of the signboard 20.

The numeral 55 denotes a closure for the upper end of the signboard 20; and that closure is a circular disk with a shallow, annular recess 57. The outer diameter of the annular recess 57 is just slightly greater than the outer diameter of the signboard 20; and the inner diameter of that annular recess is just slightly smaller than the diameter of a circle which is tangent to the inner faces of the wall 40 and of the corresponding walls 40 of the sectons 50, 52 and 54. As a result, the shallow annular recess 57 will provide a frictional fit with the upper ends of the sections 28, 50, 52 and 54 of the signboard 20. This means that the closure 55 will be held in assembled relation with the upper end of that signboard without any need of fasteners.

The numeral 56 denotes a closure for the lower end of the signboard 20; and that closure is annular in plan view and is U-shaped in cross section, as indicated particularly by FIGS. 2 and 7. The inner surface of the outer wall of the closure 56 engages the outer faces of the lower portions of the sections 28, 50, 52 and 54; and the inner surface of the inner wall of that closure engages the lower portions of the wall 40 and of the corresponding walls 40 of the sections 50, 52 and 54. Consequently, the closure 56 provides a frictional fit with the lower end of the signboard 20 when it is telescoped over the lower ends of the sections 28, 50, 52 and 54 of that signboard. The closures 55 and 56 protect the ends of the sections 28, 50, 52 and 54 of the signboard, and also protect any nearby objects from the sharp ends of those sections. Furthermore, the closure 55 conceals the interior of the signboard 20.

The abutments 44, 46 and 48 of the various sections 28, 50, 52 and 54 provide spaced, elongated, axially-extending areas of engagement between the walls 42 of those sections and the projections 38 of the adjacent sections. In doing so, the abutments facilitate the interfitting of those various sections together, and also prevent or minimize looseness or play between those various sections.

FIGS. 1 and 3 show indicia 22 secured at just one side of the signboard 20. However, if desired, indicia can be located at different circumferentially-displaced areas of that signboard. Further, although FIG. 1 shows the indicia 22 spaced along the length of the signboard 20, indicia could be grouped close to the top, close to the bottom, or at any desired location along the length of that signboard. Furthermore, where indicia are displaced circumferentially around the surface of the signboard 20, that indicia can be located at various desired positions along the length of that signboard. As a result, it should be apparent that the signboard 20 is quite versatile and can provide almost any desired combination and arrangement of inidicia.

Referring particularly to FIG. 8, the numeral 58 generally denotes a signboard which includes the sections 28, 50, 52 and 54 of the signboard of FIG. 1 plus a section 60. The latter section preferably will be identical to the section 28. Because each of the sections 28, 50, 52, 54, and 60 has an external configuration which enables it to define one quarter of the exterior of a right circular cylinder, the configuration of the signboard 58 of FIG. 8 will not be precisely cylindrical--although the out-of-roundness of that signboard has been accentuated by FIG. 8. When viewed from even a short distance, the signboard 58 will appear to be a right circular cylinder.

The section 60 will interlock with the sections 28 and 54 of the signboard 58 in the same manner in which the section 28 interlocks with the sections 50 and 54 of the signboard 20. Further, the interlocking action between the various sections 28, 50, 52, 54 and 60 will make the signboard 58 sturdy and rugged, and will prevent or minimize any looseness and play in that signboard.

The signboard 58 has a circumference which is 25% larger than the circumference of the signboard 20 of FIG. 1; and the inner diameter of the signboard 58 is 25% larger than the inner diameter of the signboard 20. In addition, the signboard 58 has four more elongated, axially-extending grooves than does the signboard 20. Because the signboard 58 of FIG. 8 has more elongated, axially-extending grooves than does the signboard 20 of FIG. 1, more groups of indicia can be attached to the former signboard in circumferentially-displaced array than can be attached to the latter signboard in such array. Alternatively, where the same indicia are to be attached to both of the signboards 58 and 20, the former signboard can provide larger circumferential displacement between those indicia.

Referring particularly to FIG. 9, the numeral 64 generally denotes a signboard which can be similar, or even identical, to the signboard 20 of FIG. 1 or to the signboard 58 of FIG. 8. Closures 66 and 68 are provided for the signboard 64; and a tube 70 is secured to, and extends downwardly from, the closure 68. A foot 72 is provided for the tube 70; and that foot can rest upon the floor of a building. The numeral 74 denotes a tube which is secured to, and which extends upwardly from, the closure 66; and that tube accommodates the lower end of a tube 76 which has a surface-engaging member 80 at the upper end thereof. A helical compression spring 78 is disposed within the tube 74; and it urges the tube 76 and the surface-engaging member 80 upwardly relative to the tube 74. A stop, not shown, will limit upward movement of the tube 76, and hence will prevent accidental separation of that tube from the tube 74. When the tube 76 is in its retracted position, the surface-engaging member 80 will be below and out of engagement with the ceiling of the room in which the signboard 64 is to be mounted. However, when that tube is in its extended position, that surface-engaging member will engage the ceiling of that room, and will coact with the foot 72 to hold the signboard 64 in vertical position.

If desired, a bearing could be provided between the tube 70 and the bottom closure 68, and a further bearing could be provided between the tube 74 and the upper closure 66. Where such bearings were provided, the signboard 64 could be rotated about a vertical axis while the foot 72 and the surface-engaging member 80 remained stationary relative to the floor and ceiling of the room.

Referring particularly to FIG. 10, the numeral 84 generally denotes a signboard which can be similar, or even identical, to the signboard 20 of FIG. 1 or to the signboard 58 of FIG. 8. A closure 86 is telescoped over the upper end of that signboard, and a closure 88 is telescoped over the lower end of that signboard. The numeral 90 denotes a base which can rest upon the floor or the ground; and the numeral 92 denotes an upright which is supported by and which extends upwardly from that base. The numeral 94 denotes a pivot which enables the closure 88, and hence the signboard 84, to rotate relative to the upright 92. If desired, of course, the pivot 94 could be replaced by a non-rotatable connection.

Referring particularly to FIG. 11, the numeral 98 generally denotes a signboard which can be similar, or even identical, to the signboard 20 of FIG. 1 or to the signboard 58 of FIG. 8. The numeral 100 denotes a hanger which can be secured to one of the joists of a ceiling and which has a pivot 104 mounted on the lower end thereof. The numeral 102 denotes a similar hanger which has a pivot 106 at the lower end thereof. The pivots 104 and 106 confront each other; and they rotatably support closures 108 and 110 which are telescoped over the opposite ends of the signboard 98.

When the hangers 100 and 102 are secured to, and depend downwardly from, the joists of a ceiling, they enable the signboard 98 to be suspended in a horizontal direction. The pivots 104 and 106 permit that signboard to be rotated about a horizontal axis so any indicia secured thereto can have any desired attitude or position.

Although the hangers 100 and 102 are shown as depending downwardly, they could be mounted so they extended upwardly. Further, those hangers could be mounted so they were horizontally directed or were inclined to the horizontal. When the hangers are mounted so they are horizontally directed, they can be set so they are in vertical registry; and, in such event, the axis of the signboard 98 will be vertical. However, if desired the hangers 100 and 102 could be set so they were out of vertical registry even though they were horizontally directed; and, in such event, the axis of the signboard 98 would be inclined to the vertical. If it became advisable to prevent rotation of the signboard 98 the pivots 104 and 106 could be replaced by fixed connections. As a result, it should be apparent that the structure shown in FIG. 11 is very versatile and can facilitate mounting of the signboard 98 in any desired attitude or position.

Although FIGS. 9–11 do not show indicia mounted on any of the signboards 64, 84 and 98, each of those signboards is intended to have indicia secured thereto. That indicia can be distributed circumferentially and axially over the surfaces of those signboards in any desired manner or arrangement. As a result, those signboards facilitate the grouping of the indicia in the most useful and practical manner.

Referring particularly to FIG. 12, the numeral 112 generally denotes a signboard which can be similar, or even identical, to the signboard 20 of FIG. 1 or to the signboard 58 of FIG. 8. A closure 116, which can be identical to the closure 56 in FIG. 7, is telescoped over the upper end of that signboard; and a similar closure 118 is telescoped over the lower end of that signboard. The signboard 112 is telescoped over a vertically-directed post 120. The numeral 114 denotes a signboard which is identical to the signboard 112; and that signboard is equipped with un-numbered closures with are identical to the closures 116 and 118. The signboard 114 is telescoped over a post 121 which is parallel to, but which is spaced a short distance from, the post 120. Those posts support a panel or other display 123 which can bear indicia, pictures or other material. The signboards 112 and 114 bear indicia which are held by resilient clips that extend into some of the elongated, axially-extending grooves in the exterior surfaces of those signboards. Those indicia are shown in FIG. 12 as the words TIRES and PARTS.

The inner diameters of the signboards 112 and 114 are shown as being just slightly larger than the diameters of the posts 120 and 121; and hence those posts will closely limit any departures of the axes of those signboards from the axes of those posts. However, if desired, the inner diameters of the signboards 112 and 114 could be made considerably larger than the diameters of the posts 120 and 121. Regardless of the inner diameters of the signboards 112 and 114, suitable supporting members, not shown, will extend between the posts 120 and 121 and those signboards to hold those signboards in position relative to those posts.

The signboards 112 and 114 are shown positioned close to the upper ends of the posts 120 and 121; but those signboards could be positioned at any desired points along the lengths of those posts. Further, the signboard 112 could be displaced vertically relative to the signboard 114. In addition, if desired, one or both of the signboards 112 and 114 could be made long enough to completely conceal the post which it surrounds, and, where that is done, that post need not be ornamental in appearance.

The closure 118 for the signboard 112 and the corresponding closure for the signboard 114 are desirable, because they protect the lower ends of the sections of those signboards. Also, those closures are desirable because they provide "finished" appearances for the lower ends of those signboards. However, those closures are not essential; and the bare lower ends of the signboards 112 and 114 could be telescoped over the posts 120 and 121. The signboard 58 of FIG. 8 is shown without closures at the top or bottom; and either end of that signboard could be telescoped over a post or upright.

Because the signboard 58 of FIG. 8 can be telescoped over a post or upright, and because either of the signboards 112 and 114 can be telescoped over a post or upright, those signboards can be set in position quickly, easily and inexpensively. Further, each of those signboards can be quickly, easily and inexpensively replaced by shorter or longer signboards or by signboards of larger or smaller diameters. Moreover, each of those signboards can be disposed with its lower end resting on the floor or with its lower end in register with any desired point along the length of a post or upright.

It will be noted that the support 70 and the signboard 64 in FIG. 7 are coaxial, and that the support 92 and the signboard 84 of FIG. 8 are coaxial; and such arrangements are desirable. However, if space or attention-getting factors warrant it, the axis of either of those signboards could be displaced from the axis of the support therefor.

If desired, an electric motor could be mounted in the upper end of the upright 92; and a gear-type or friction-type drive could be used to connect the armature of that motor to the closure 88. In that event, the signboard 84 could be rotated at a desired speed to recurrently move the indicia thereon into and out of view.

The signboards which are shown in the drawing have elongated, axially-extending grooves that are spaced around the exterior thereof; and those signboards have convex surfaces intermediate those grooves. If desired, however, the surfaces which are intermediate those grooves could be planar, could be concave, or could be complex surfaces. However, because those elongated grooves and those intermediate surfaces are intended to, and do, serve as backgrounds for the indicia mounted on those signboards, those intermediate surfaces preferably will be convex.

Whereas the drawing and accompanying description have shown and described some preferred embodiments of the present invention, it should be apparent to those skilled in the art that various changes may be made in the form of the invention without affecting the scope thereof.

What I claim is:

1. A signboard which is elongated and tubular and which is generally circular in cross section and which comprises a plurality of sections that are elongated and that are generally arcuate in cross section, said sections being disposed in edge-to-edge relation to make said signboard tubular and to define said circular cross section for said signboard, each of said sections having portions of the outer surface thereof coacting with portions of the outer surfaces of the rest of said sections to define a cylinder of generally circular cross section, each of said sections having the circumferentially-spaced elongated side edges thereof displaced radially inwardly of said cylinder of generally circular cross section, each of said sections having interacting surfaces adjacent said inwardly-displaced elongated side edges thereof which mate with and coact with complementary surfaces adjacent said inwardly-displaced elongated side edges of abutting sections to interlock said sections together, said interacting surfaces adjacent said inwardly-displaced elongated side edges of said abutting sections enabling said sections to define and constitute a frame-free signboard, the inward displacement of said elongated side edges of each of said sections making the joints between abutting sections less visible than said portions of said outer surfaces of said sections which define said cylinder of generally circular cross section.

2. A signboard which is elongated and tubular and which is generally circular in cross section and which comprises a plurality of sections that are elongated and that are generally arcuate in cross section, said sections being disposed in edge-to-edge relation to make said signboard tubular and to define said circular cross section for said signboard, at least some of said sections having axially-directed and circumferentially-spaced indicia-holding grooves in the exterior surfaces thereof, each of said sections having interacting surfaces adjacent the elongated edges thereof which mate with and coact with complementary surfaces adjacent the elongated edges of abutting sections to interlock said sections together, said interacting surfaces adjacent the elongated edges of said abutting sections enabling said sections to define and constitute a frame-free signboard, said interacting surfaces being hinge-like in configuration to permit some of said sections to be set in edge-to-edge relation and then rotated relative to each other to interlock them in assembled relation.

3. A signboard which is elongated and tubular and which is generally circular in cross section and which comprises a plurality of sections that are elongated and that are generally arcuate in cross section, said sections being disposed in edge-to-edge relation to make said signboard tubular and to define said circular cross section for said signboard, at least some of said sections having axially-directed and circumferentially-spaced inidicia-holding grooves in the exterior surfaces thereof, each of said sections having interacting surfaces adjacent the elongated edges thereof which mate with and coact with complementary surfaces adjacent the elongated edges of abutting sections to interlock said sections together, said interacting surfaces adjacent the elongated edges of said abutting sections enabling said sections to define and constitute a frame-free signboard, said sections defining an essentially planar lower end for said signboard so said signboard can be "free standing", said lower end of said signboard being open to enable said signboard to be telescoped over a support to rest upon said lower end.

4. A signboard which is generally arcuate in cross section and which comprises a plurality of elongated sections that are generally arcuate in cross section and that are disposed in edge-to-edge relation to define said generally-arcuate cross section for said signboard, at least some of said sections having circumferentially-spaced indicia-holding means thereon, and those sections of said signboard which abut each other having interacting surfaces thereon which engage and coact with each other to interlock said sections together, said interacting surfaces interlocking the abutting sections of said signboard while permitting said abutting sections to be disposed in slightly-different relative angular positions, whereby "*n*" number of said sections can have said interacting surfaces thereon interlocked together to define a tubular signboard of a predetermined size and whereby a "n+1" number of said sections can have said interacting surfaces thereon interlocked together to define a tubular signboard of a larger size.

5. A signboard which is tubular and which is generally arcuate in cross section and which comprises a plurality of elongated sections that are generally arcuate in cross section and that are disposed in edge-to-edge relation to make said sign-board tubular and to define said generally-arcuate cross section for said signboard, at least some of said sections having circumferentially-spaced indicia-holding means thereon, and those sections of said signboard which abut each other having interacting surfaces thereon which engage and coact with each other to interlock said sections together, said interacting surfaces being hinge-like in configuration to permit some of said sections to be set in edge-to-edge relation and then rotated relative to each other to interlock them in assembled relation.

6. A signboard which is tubular and which is generally arcuate in cross section and which comprises a plurality of elongated sections that are generally arcuate in cross section and that are disposed in edge-to-edge relation to make said sign-board tubular and to define said generally-arcuate cross section for said signboard, at least some of said sections having circumferentially-spaced indicia-holding means thereon, and those sections of said signboard which abut each other having interacting surfaces thereon which engage and coact with each other to interlock said sections together, said interacting surfaces being hinge-like in configuration to permit some of said sections to be set in edge-to-edge relation and then rotated relative to each other to interlock them in assembled relation, one of said interacting surfaces comprising an axially-extending wall of arcuate cross section, and another of said interacting surfaces comprising an axially-extending projection of arcuate cross section.

7. A signboard which is tubular and which is generally arcuate in cross section and which comprises a plurality of elongated sections that are generally arcuate in cross section and that are disposed in edge-to-edge relation to make said signboard tubular and to define said generally-arcuate cross section for said signboard, at least some of said sections having circumferentially-spaced indicia-holding means thereon, and those sections of said signboard which abut each other having interacting surfaces thereon which engage and coact with each other to interlock said sections together, said interacting surfaces being hinge-like in configuration to permit some of said sections to be set in edge-to-edge relation and then rotated relative to each other to interlock them in assembled relation, one of said interacting surfaces comprising an axially-extending wall of arcuate cross section, another of said interacting surfaces comprising an axially-extending wall of arcuate cross section, and said other axially-extending wall fitting within said one axially-extending wall in hinge-like fashion.

8. A signboard which is tubular and which is generally arcuate in cross section and which comprises a plurality of elongated sections that are generally arcuate in cross section and that are disposed in edge-to-edge relation to make said signboard tubular and to define said generally-arcuate cross section for said signboard, at least some of said sections having circumferentially-spaced indicia-holding means thereon, and those sections of said signboard which abut each other having interacting surfaces thereon which engage and coact with each other to interlock said sections together, said interacting surfaces being hinge-like in configuration to permit some of said sections to be set in edge-to-edge relation and then rotated relative to each other to interlock them in assembled relation, one of said interacting surfaces comprising an axially-extending wall of arcuate cross section, another of said interacting surfaces comprising an axially-extending projection of arcuate cross section, and elongated, axially-extending abutments on said axially-extending wall that confront and confine said axially-extending projection.

9. A signboard which is elongated and tubular and which is generally circular in cross section and which comprises a plurality of sections that are elongated and that are generally arcuate in cross section, said sections being disposed in edge-to-edge relation to make said signboard tubular and to define said circular cross section for said signboard, each of said sections having portions of the outer surface thereof coacting with portions of the outer surfaces of the rest of said sections to define a cylinder of generally circular cross section, each of said sections having the circumferentially-spaced elongated side edges thereof displaced radially inwardly of said cylinder of generally circular cross section, each of said sections having interacting surfaces adjacent said inwardly-displaced elongated side edges thereof which mater with and coact with complementary surfaces adjacent said inwardly-displaced elongated side edges of abutting sections to interlock said sections together, said interacting surfaces adjacent said inwardly-displaced elongated side edges of said abutting sections enabling said sections to define and constitute a frame-free signboard, the inward displacement of said elongated side edges of each of said sections making the joints between abutting sections less visible than said portions of said outer surfaces of said sections which define said cylinder of generally circular cross section, said inwardly-displaced elongated side edges of said abutting sections coacting to define longitudinally-extending grooves opening to the outer surface of said signboard, at least one of said sections having a longitudinally-extending groove therein opening to the outer surface thereof, and said groove in said section having substantially the same configuration as one of said longitudinally-extending grooves defined by said inwardly-displaced elongated side edges of said abutting sections.

10. A signboard which is elongated and tubular and which is generally circular in cross section and which comprises a plurality of sections that are elongated and that are generally arcuate in cross section, said sections being disposed in edge-to-edge relation to make said signboard tubular and to define said circular cross section for said signboard, each of said sections having portions of the outer surface thereof coacting with portions of the outer surfaces of the rest of said sections to define a cylinder of generally circular cross section, each of said sections having the circumferentially-spaced elongated side edges thereof displaced radially inwardly of said cylinder of generally circular cross section, each of said sections having interacting surfaces adjacent said inwardly-displaced elongated side edges thereof which mate with and coact with complementary surfaces adjacent said inwardly-displaced elongated side edges of abutting sections to interlock said sections together, said inwardly-displaced elongated side edges of said abutting sections coacting to define longitudinally-extending grooves opening to the outer surface of said signboard, said interacting surfaces adjacent said inwardly-displaced elongated side edges of said abutting sections having portions thereof which extend inwardly toward the center of said signboard rather than extending into said longitudinally-extending grooves, the inward displacement of said elongated side edges of each of said sections making the joints between abutting sections less visible than said portions of said outer surfaces of said sections which define said cylinder of generally circular cross section.

* * * * *